US011186426B2

(12) United States Patent
Cohen et al.

(10) Patent No.: US 11,186,426 B2
(45) Date of Patent: Nov. 30, 2021

(54) GLASS STORAGE TOOL AND GLASS STORAGE SYSTEM

(71) Applicant: WEARTECH LTD., Toyama (JP)

(72) Inventors: Richard Brighton Colin Cohen, Toyama (JP); Rika Unno, Tokyo (JP)

(73) Assignee: WEARTECH LTD., Toyama (JP)

( * ) Notice: Subject to any disclaimer, the term of this patent is extended or adjusted under 35 U.S.C. 154(b) by 0 days.

(21) Appl. No.: 16/636,647

(22) PCT Filed: Mar. 19, 2018

(86) PCT No.: PCT/JP2018/010714
§ 371 (c)(1),
(2) Date: Feb. 5, 2020

(87) PCT Pub. No.: WO2019/030962
PCT Pub. Date: Feb. 14, 2019

(65) Prior Publication Data

US 2020/0346847 A1 Nov. 5, 2020

(30) Foreign Application Priority Data

Aug. 9, 2017 (JP) ..... JP2017-154498

(51) Int. Cl.
*B65D 85/30* (2006.01)
*A47B 81/04* (2006.01)
*B65D 21/02* (2006.01)

(52) U.S. Cl.
CPC ..... *B65D 85/30* (2013.01); *A47B 81/04* (2013.01); *B65D 21/0212* (2013.01)

(58) Field of Classification Search
CPC .. B65D 85/30; B65D 21/0212; B65D 85/305; B65D 85/44; B65D 1/243; A47B 81/04;
(Continued)

(56) References Cited

U.S. PATENT DOCUMENTS 3,009,579 A * 11/1961 Ettlinger, Jr. ..... A47L 15/501 211/41.2
4,621,739 A * 11/1986 Heymann ..... A47L 19/04 211/126.14

(Continued)

FOREIGN PATENT DOCUMENTS

JP H03505440 A 11/1991
JP 2001287722 A 10/2001

(Continued)

OTHER PUBLICATIONS

International Search Report and Written Opinion issued in corresponding International Patent Application No. PCT/JP2018/010714 (with English translation of International Search Report) dated Jun. 26, 2018 (9 pages).

*Primary Examiner* — Rafael A Ortiz
*Assistant Examiner* — Sanjidul Islam
(74) *Attorney, Agent, or Firm* — Kilyk & Bowersox, P.L.L.C.

(57) ABSTRACT

A glass storage tool capable of preventing a glass from being broken is provided. The glass storage tool includes: a side wall that surrounds a glass; and a bottom plate that has a glass placement part on which the glass is placed and of which the glass placement part is held at a position higher than a lower end of the side wall. The glass placement part has a substantially circular opening and two or more annular support parts substantially concentrically arranged within the opening, an outermost one of the annular support parts is connected to a circumferential edge part of the opening by three or more beam parts extending in a radial direction, and the annular support parts are mutually connected by three or more beam parts extending in the radial direction.

5 Claims, 11 Drawing Sheets

(58) Field of Classification Search
CPC ..... A47G 23/0208; A47G 23/0216; A47G 23/0241; A45C 2200/20
USPC ..... 206/529, 230, 585, 429, 433
See application file for complete search history.

(56) References Cited

U.S. PATENT DOCUMENTS

| | | | | |
|---|---|---|---|---|
| 5,078,292 | A | 1/1992 | Cremer | |
| 5,651,461 | A * | 7/1997 | Apps | B65D 21/04 206/503 |
| 8,893,891 | B2 * | 11/2014 | Apps | B65D 71/70 206/509 |
| 8,950,595 | B2 * | 2/2015 | Ammon | A47L 15/50 211/41.8 |
| 9,095,249 | B2 * | 8/2015 | Domenech Grau | A47L 15/501 |
| 2002/0117461 | A1 * | 8/2002 | Laupan | A47L 15/501 211/41.8 |
| 2010/0084302 | A1 * | 4/2010 | Apps | B65D 1/243 206/503 |
| 2011/0056861 | A1 | 3/2011 | Apps | |
| 2014/0102933 | A1 * | 4/2014 | Meers | B65D 1/243 206/459.5 |
| 2016/0200479 | A1 | 7/2016 | Clark et al. | |

FOREIGN PATENT DOCUMENTS

| | | | |
|---|---|---|---|
| JP | 2003054533 | A | 2/2003 |
| JP | 2007047546 | A * | 2/2007 |
| JP | 2007047546 | A | 2/2007 |

* cited by examiner (a)

(b)

(a)

(b)

GLASS STORAGE TOOL AND GLASS STORAGE SYSTEM

This application is a National Stage Application of PCT/JP2018/010714, filed Mar. 19, 2018, which claims the priority of Japanese Patent Application No. 2017-154498, filed Aug. 9, 2017, which is incorporated herein by reference.

TECHNICAL FIELD

The present invention relates to a glass storage tool and a glass storage system, and in more detail, to the improvement of a glass storage tool that stores a glass.

BACKGROUND ART

In general, a wine glass is very easily broken by falling or colliding with a table or the like. In order to prevent such breakage of a glass, it is necessary to suppress impact or vibration externally applied to a glass.

SUMMARY OF INVENTION

Technical Problem

Therefore, it is conceivable to store and protect a wine glass in a glass case. Specifically, it is conceivable to use a glass case which is made by processing material having high mechanical strength and has structural flexibility to the extent that it is deformed by the above impact or vibration. For example, it is conceivable to fabricate a glass case by processing a material having high mechanical strength, such as polypropylene (PP), in a mesh-like plate shape. In particular, it is conceivable to use a glass case whose bottom part, which when applied with a large force at the time of a fall or the like, has flexibility that absorbs impact or vibration.

However, there has been a problem that when the bottom part of the glass case is applied with an external force and the bottom part is deformed, a glass is likely to be damaged depending on the resulting deformed state. The glass is stored contacting with the bottom part, and in particular, when the glass is stored in an upside-down state, the most fragile lip part contacts with the bottom part. For this reason, there has been a problem that when the bottom part is applied with an external force, the glass is likely to be broken.

The present invention has been made in consideration of the above situation, and intends to provide a glass storage tool capable of preventing a glass from being broken. In particular, it is intended to provide a glass storage tool which is capable of preventing a glass from being broken even when a force large enough to cause deformation on the bottom part is applied.

Also, the present invention intends to provide a glass storage system capable of, when mutually coupling two or more glass storage tools, preventing the glass storage tools from being easily mutually separated.

Solution to Problem

A glass storage tool according to a first aspect of the present invention includes: a side wall that surrounds a glass; and a bottom plate that has a glass placement part on which the glass is placed and of which the glass placement part is held at a position higher than the lower end of the side wall. The glass placement part has a substantially circular opening and two or more annular support parts substantially concentrically arranged within the opening, the outermost one of the annular support parts is connected to the circumferential edge part of the opening by three or more beam parts extending in the radial direction, and the annular support parts are mutually connected by three or more beam parts extending in the radial direction.

In this glass storage tool, since the glass placement part of the bottom plate can be held at a position higher than the lower end of the side wall, a space for local deformation of the bottom plate can be secured. Also, when an external force is applied to the bottom plate, the external force is distributed to the annular support parts and the beam parts. At this time, the beam parts are likely to bend or curve in a vertical direction, and therefore likely to cause relative displacement in the radial direction, whereas the annular support parts are supported displaceable in the vertical direction by the beam parts, and therefore unlikely to cause relative displacement in the circumferential direction. For this reason, when external impact is applied, the impact is absorbed by the relative displacement of the beam parts in the radial direction, while the relative displacement in the circumferential direction is suppressed, making it possible to suppress a force from being concentrated on a part of the rim part of the glass.

Also, the two or more annular support parts having different diameters contribute to support the glass, and therefore variously sized glasses can be protected from impact. Further, each of the annular support parts is supported by three or more beam parts having different circumferential positions, and therefore the glass can be stably held.

A glass storage tool according to a second aspect of the present invention is such that, in addition to the above configuration, the beam parts are formed differentiated in circumferential position between the inner side and the outer side of each of the annular support parts. According to such a configuration, relative displacement occurring in one of the sets of beam parts on the inner side and the outer side of the annular support part is suppressed from causing relative displacement in the other set of beam parts, thus making it possible to improve the performance of absorbing impact or vibration.

A glass storage tool according to a third aspect of the present invention is such that, in addition to the above configuration, the annular support parts and the beam parts are all such that their thickness is a half or less of their width, and the bottom plate is formed with ribs that surround through-holes formed between the annular support parts and the beam parts within the opening. According to such a configuration, the annular support parts and the beam parts easily bend in the vertical direction, thus making it possible to improve the performance of absorbing impact or vibration. In addition, the peripheral edge parts of the through-holes are reinforced by ribs, and therefore the stiffness of the bottom plate can be improved.

A glass storage tool according to a fourth aspect of the present invention is such that, in addition to the above configuration, the upper surface of the circumferential edge part is a tilted surface whose height is lowered toward the inner side in the radial direction. According to such a configuration, when the glass is stored with the center of the glass displaced from the center of the glass placement part, the glass is guided so that the center of the glass is brought close to the center of the glass placement part by the tilted surface of the circumferential part. For this reason, the glass can be suppressed from being held with the rim part of the glass largely displaced from the annular support parts.

A glass storage system according to a fifth aspect of the present invention is a glass storage system in which two or more glass storage tools respectively storing glasses are coupled in a longitudinal direction or a lateral direction, the glass storage tools each has: a side wall that surrounds a glass; and a bottom plate whose glass placement part on which the glass is placed is held at a position higher than the lower end of the side wall, and the glass placement part has a substantially circular opening and two or more annular support parts substantially concentrically arranged within the opening, the outermost one of the annular support parts is connected to the circumferential edge part of the opening by three or more beam parts extending in the radial direction, and the annular support parts are mutually connected by three or more beam parts extending in the radial direction, and the glass storage system includes: a means of storage tool coupling adapted to couple two of the glass storage tools to each other by relatively sliding the glass storage tools in a vertical direction with side walls facing each other; and a stopper that, through an engagement hole provided at the upper end of one of the two side walls coupled by the means of storage tool coupling, engages with the upper end of the other, and thereby restricts the two glass storage tools from sliding in the vertical direction.

In the glass storage system, the two glass storage tools coupled by the means of storage tool coupling are restricted by the stopper from mutually sliding in the vertical direction, and therefore the two glass storage tools are tightly coupled to each other. For this reason, when two or more glass storage tools are mutually coupled, the glass storage tools can be prevented from being easily mutually separated.

A glass storage system according to a sixth aspect of the present invention is such that, in addition to the above configuration, the two side walls coupled by the means of storage tool coupling are restricted by at least two stoppers whose insertion directions are opposite from sliding in the vertical direction. According to such a configuration, the multiple stoppers engaging with the two side walls coupled by the means of storage tool coupling can be suppressed from simultaneously falling out by impact or vibration at the time of a fall.

Advantageous Effects of Invention

The glass storage tool according to the present invention is capable of holding a glass without easily breaking it. In particular, a force can be suppressed from being concentrated on the rim part of a glass, and therefore even when a force enough to cause deformation on the bottom part of the glass storage tool is applied, the glass can be prevented from being broken.

Also, in the glass storage system according to the present invention, since the two glass storage tools are tightly coupled to each other, when two or more glass storage tools are mutually coupled, the glass storage tools can be prevented from being easily mutually separated.

DESCRIPTION OF EMBODIMENTS

<Glass Storage Tool 1>

Figure 1:
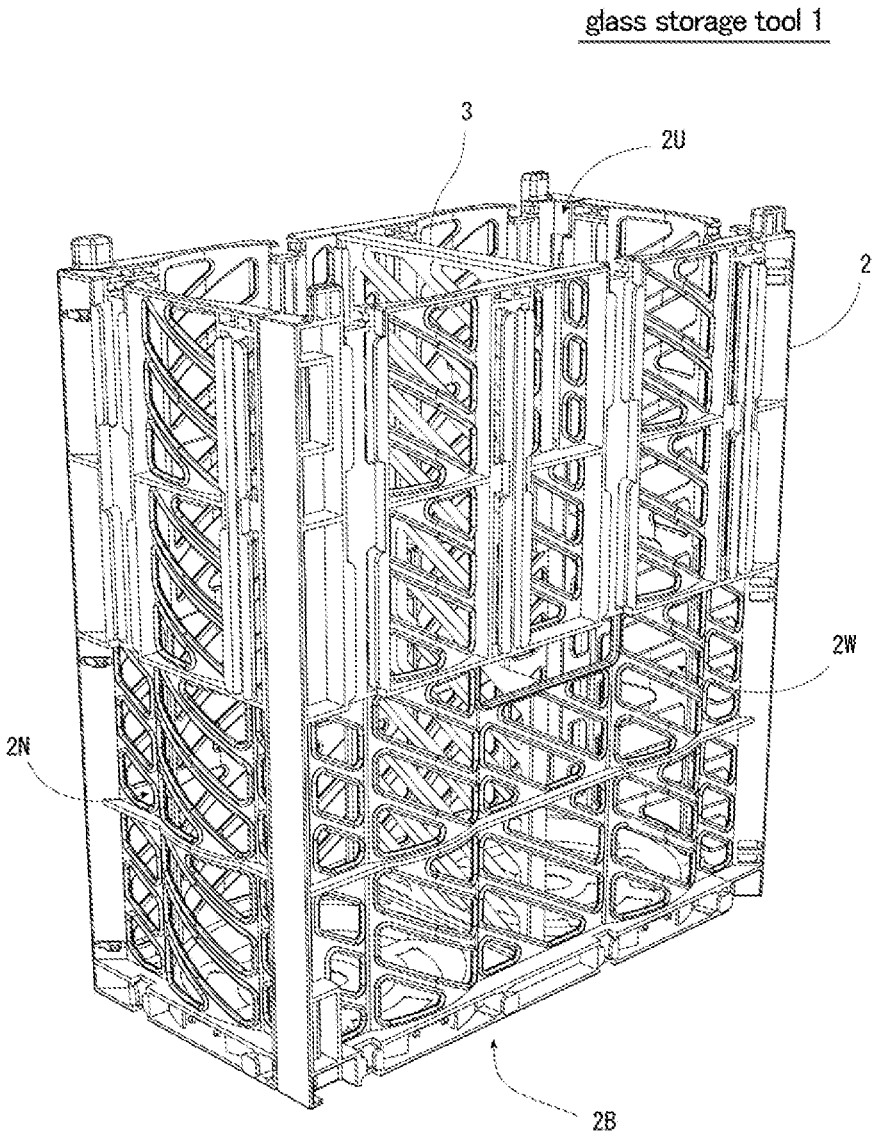
FIG. 1 is a perspective view illustrating one configuration example of a glass storage tool 1 according to an embodiment of the present invention.
Figure 2:
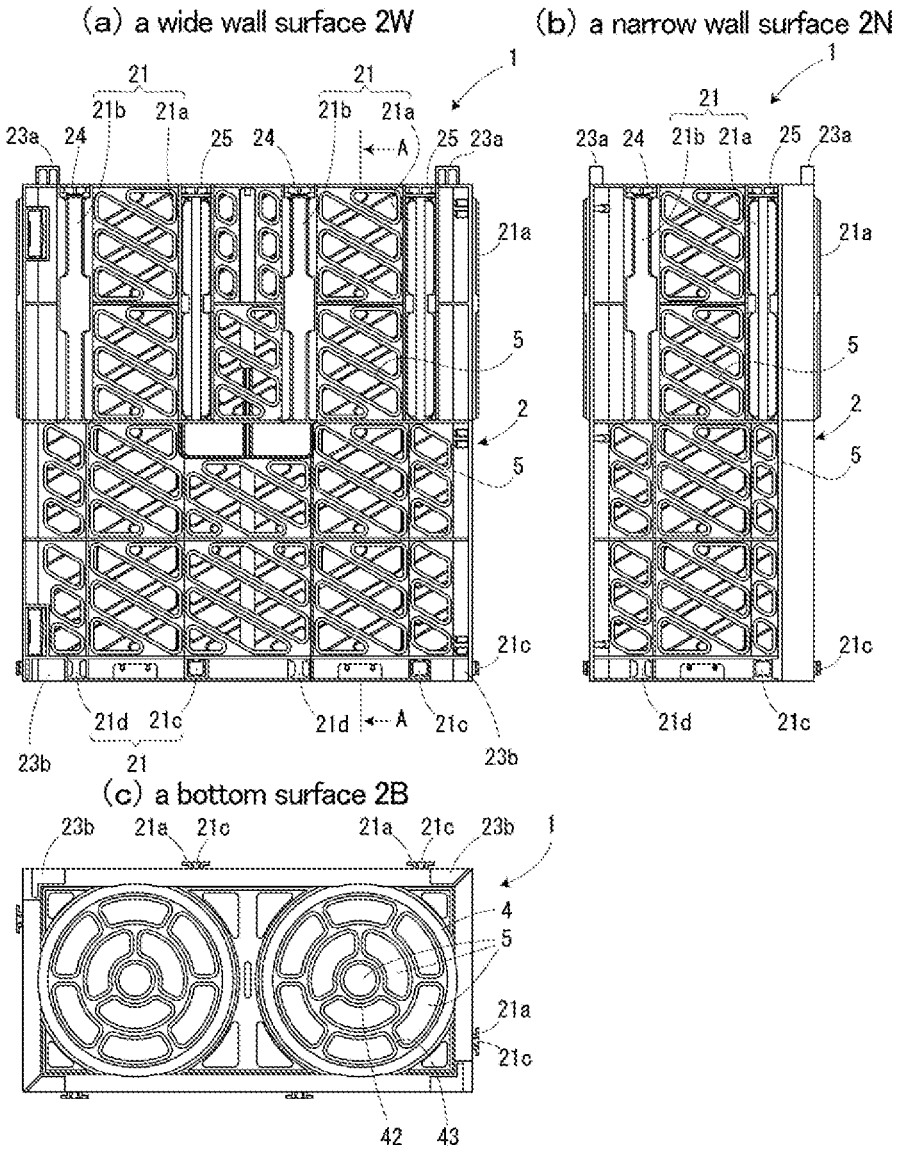
FIG. 2 is a diagram illustrating a wide wall surface, a narrow wall surface, and a bottom surface of the glass storage tool 1 in FIG. 1.
Figure 3:
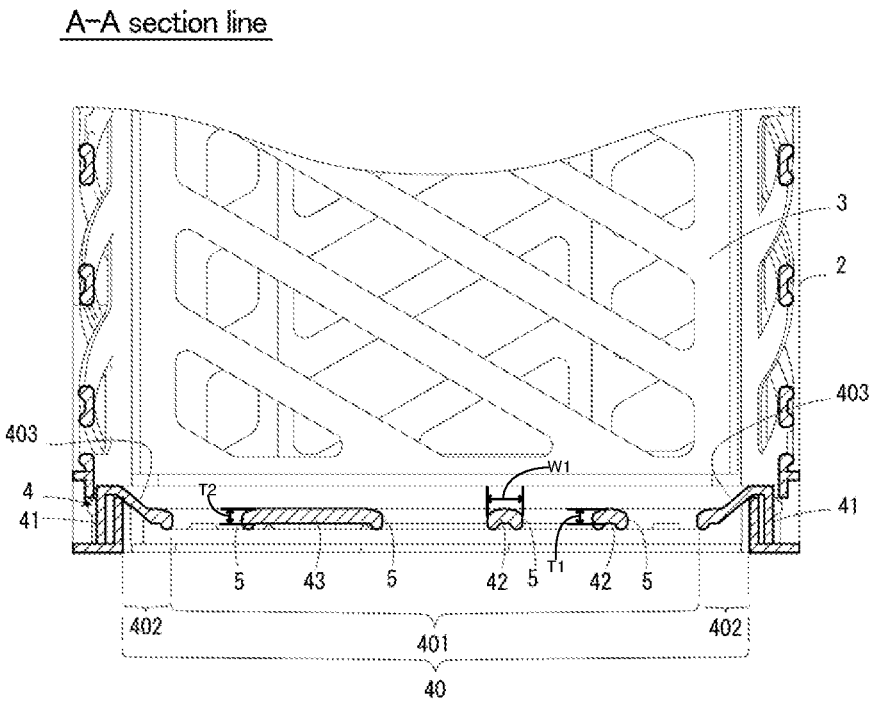
FIG. 3 is a cross-sectional view illustrating part of an enlarged cross section when cutting the glass storage tool 1 in FIG. 2 along an A-A section line.

FIG. 1 is a perspective view illustrating one configuration example of a glass storage tool 1 according to an embodiment of the present invention, in which the appearance when viewing the glass storage tool 1 from obliquely above is illustrated. FIG. 2 is a diagram illustrating the glass storage tool 1 in FIG. 1, in which (a) illustrates a wide wall surface 2W of the glass storage tool 1, (b) illustrates a narrow wall surface 2N, and (c) illustrates a bottom surface 2B. FIG. 3 is a cross-sectional view illustrating part of an enlarged cross section when cutting the glass storage tool 1 in FIG. 2 along an A-A section line.

The glass storage tool 1 is a resin case for storing glasses, and used to keep, carry, and wash the glasses. The glasses are glass tableware for drinks. The glass storage tool 1 stores, for example, wine glasses.

A wine glass has structure in which a main body part called a bowl is connected to a disk-shaped base part called a plate via an elongated leg part called a stem. The rim part of the main body part is formed thin because it is used as a lip, and has the property of being easily broken.

By storing a wine glass in the glass storage tool 1 except when the wine glass is in use, the wine glass can be prevented from being broken. For example, when loading the glass storage tool 1 storing the wine glass into a washer, the wine glass can be prevented from being broken during washing. Also, by keeping in a state of being stored in the glass storage tool 1 after washing, the wine glass can be prevented from being broken during keeping. Further, by carrying in the state of being stored in the glass storage tool 1, the wine glass can be prevented from being broken during handling. The wine glass is stored in the glass storage tool 1 in a state where, for example, the opening of the main body part faces downward.

The glass storage tool 1 consists of: a side wall 2 that surrounds a glass; a bottom plate 4 on which a glass is placed; and a divider 3 that divides an internal space of a rectangular parallelepiped shape surrounded by the side wall 2 into two glass storage compartments, and is capable of simultaneously storing two glasses. Also, the glass storage tool 1 has an opening on the upper surface, and is capable of storing a glass through the opening. The side wall 2, bottom plate 4, and divider 3 are provided with many through-holes 5, which allow washing liquid to pass there-through during washing of a glass and are also suitable for draining and drying of the glass.

The side wall 2 is provided with storage tool coupling parts 21 for coupling two or more glass storage tools 1 in a longitudinal direction or a lateral direction in a horizontal plane; engagement concave parts 23*a* and engagement convex parts 23*b* for stacking two or more glass storage tools 1 in a vertical direction; and engagement holes 24 and 25 for engaging the below-described stoppers 6.

The outer wall surfaces of the side wall 2 includes a wide wall surface 2W whose horizontal length is long and a narrow wall surface 2N whose horizontal length is short. Here, the horizontal direction in which the wide wall surface 2W extends is referred to as the longitudinal direction, and the horizontal direction in which the narrow wall surface 2N extends is referred to as the lateral direction. The length of the wide wall surface 2W in the longitudinal direction is substantially twice the length of the narrow wall surface 2N in the lateral direction.

The storage tool coupling parts 21 are coupling means adapted to couple two glass storage tools 1 to each other by relatively sliding the glass storage tools 1 in the vertical direction with side walls 2 facing each other. The storage tool coupling parts 21 each consists of a rail part 21*a* and an engagement groove 21*b* that extend in the vertical direction, and a protrusion part 21*c* and an engagement hole 21*d* that are provided in the vicinity of the lower end of the side wall 2. The rail part 21*a* and the protrusion part 21*c* of one of the glass storage tools 1 are respectively accommodated in the engagement groove 21*b* and the engagement hole 21*d* of the other glass storage tool 1, and between the two glass storage tools 1, relative movements in the longitudinal direction and in the lateral direction are restricted.

The rail part 21*a* and the protrusion part 21*c* protrude from the wall surface, and are formed of two claws whose cross sections along the horizontal plane are L-shaped. The engagement groove 21*b* and the engagement hole 21*d* are formed of concave parts formed by concaving the wall surface, and the cross-sections of the concave parts along the horizontal plane are T-shaped. The wide wall surface 2W is provided with the two rail parts 21*a* and the two engagement grooves 21*b*, and the rail parts 21*a* and the engagement grooves 21*b* are alternately arranged in the longitudinal direction. On the other hand, the narrow wall surface 2N is provided with the one rail part 21*a* and the one engagement groove 21*b*. The protrusion parts 21*c* are provided corresponding to the rail parts 21*a*, and the engagement holes 21*d* are provided corresponding to the engagement grooves 21*b*. By engaging a storage tool coupling part 21 with a storage tool coupling part 21 of the other glass storage tool 1, wide walls 2W, narrow walls 2N, or a wide wall 2W and a narrow wall 2B can be connected to each other.

The engagement concave parts 23*b* are coupling means adapted to accommodate the engagement convex parts 23*a* of the other glass storage tool 1, and provided at the lower end of the side wall 2. On the other hand, the engagement convex parts 23*a* are coupling means adapted to be inserted into the engagement concave parts 23*b* of the other glass storage tool 1, and protrude upward from the upper end surface of the side wall 2. The engagement convex parts 23*a* are respectively formed at the four corners of the upper opening surface 2U of the glass storage tool 1. On the other hand, the engagement concave parts 23*b* are respectively formed on the bottom surface at positions opposite to the engagement convex parts 23*a*.

With the bottom surface 2B of one of glass storage tools 1 facing the upper opening surface 2U of the other glass storage tool 1, the two glass storage tools 1 can be stacked in the vertical direction. The stacked two glass storage tools 1 are restricted from relatively moving in the longitudinal direction and the lateral direction because the four engagement convex parts 23*a* and the four engagement concave parts 23*b* respectively engage with each other.

The engagement holes 24 are through-holes for inserting the stoppers in the horizontal direction, and provided at the upper end of the side wall 2. The engagement holes 24 are arranged above the engagement grooves 21*b*. The engagement holes 25 are concave parts that are for accommodating the fore end parts of the stoppers and concave in the horizontal direction, and provided at the upper end of the side wall 2. The engagement holes 25 are arranged above the rail parts 21*a*.

The bottom plate 4 consists of: two glass placement parts 40 on which glasses are respectively placed; and a frame part 41 extending along the outer edge of the bottom plate 4 and surrounding the glass placement parts 40. The glass placement parts 40 include substantially circular areas and are held at a higher position than the lower end of the side wall 2 by the frame part 41 in order to secure a space for when locally deformed. That is, the lower surfaces of the glass placement parts 40 are arranged on the upper side of the lower end of the side wall 2. The glass placement parts 40 each has: a substantially circular opening 401; two or more annular support parts 42 substantially concentrically arranged within the opening 401; and beam parts 43 radially extending within the opening 401. Also, the glass placement parts 40 each includes a circumferential edge part 402 surrounding the opening 401.

The annular support parts 42 are ring members that are for supporting the rim part of a glass and extend in the circumferential direction. In the bottom plate 4, two annular support parts 42 having different diameters are arranged concentrically with the glass placement part 40. The outermost annular support part 42 of them is connected to the circumferential edge part 402 of the opening 401 by three or more radially extending beam parts 43. In addition, the two annular support parts 42 are also connected to each other by three or more radially extending beam parts 43.

Specifically, the inner annular support part 42 and the outer annular support part 42 are connected by three beam parts 43 having different circumferential positions, and the outer annular support part 42 and the circumferential edge part 402 are connected by six beam parts 43 having different circumferential positions. That is, the annular support parts 42 are arranged so that the number of the outer beam parts 43 is larger than the number of the inner beam parts 43.

In addition, assuming that it is called relative displacement in the radial direction that a vertical displacement amount differs depending on a position in the radial direction, in order to prevent the relative displacement in the radial direction from being directly transmitted, the beam parts 43 are formed differentiated in circumferential position between the inner side and outer side of the annular support part 42. The respective beam parts 43 are arranged at substantially regular intervals in the circumferential direction. The annular support part 42 is adapted to have sizes opposite to the rim part of a glass.

The glass placement parts 40 are held at a higher position than the lower end of the side wall 2 to secure a space for when locally deformed. This makes it possible to ensure the performance of absorbing impact or vibration at the time of a fall. Also, it is possible to suppress the impact or vibration at the time of a fall from being applied directly to the glass placement parts 40.

When an external force is applied to the bottom plate 4, the external force is distributed to the annular support parts 42 and the beam parts 43. At this time, the beam parts 43 easily bend or curve in the vertical direction, and vertical displacement is likely to locally increase in the radial direction. That is, the beam parts 43 are likely to cause the relative displacement in the radial direction. In contrast, the annular support parts 42 are supported displaceable in the vertical direction by the beam parts 43, and therefore the vertical displacement is unlikely to locally increase in the circumferential direction. That is, the annular support parts 42 are unlikely to cause the relative displacement in the circumferential direction. For this reason, when external impact is applied, the impact is absorbed by the relative displacement of the beam parts 43 in the radial direction, while the relative displacement in the circumferential direction is suppressed, thus making it possible to suppress a force from being concentrated on part of the rim part of a glass.

Also, a glass is supported by the two or more annular support parts 42 having different diameters, and therefore variously sized glasses can be protected from impact. Further, the annular support parts 42 are each supported by three or more beam parts 43 having different circumferential positions, and can therefore stably hold a glass.

Figure 5:
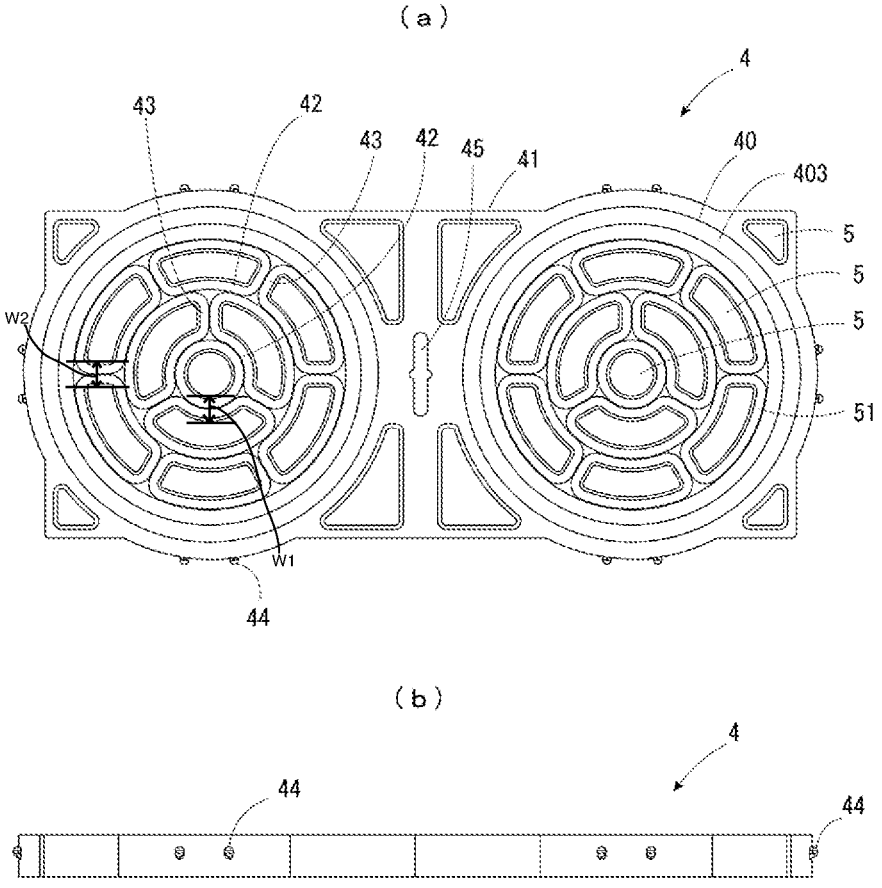
FIG. 5 is a diagram illustrating a bottom plate 4 of the glass storage tool 1.

FIGS. 3 and 5 illustrate that the annular support parts 42 each have a thickness (T1) and a width (W1) and the beam parts 43 each have a thickness (T2) and a width (W2). The thickness (T1, T2) is a dimension in a vertical direction relative to the side wall 2 and the width (W1, W2) is a dimension in a horizontal direction relative to the side wall 2. The annular support parts 42 are all such that, for example, the thickness (T1) is a half or less of the width (W1). The beam parts 43 are all such that, for example, the thickness (T2) is a half or less of the width (W2). Making the thickness (T1, T2) thinner than the width (W1, W2) makes it easy for the annular support parts 42 and the beam parts 43 to bend in the vertical direction, the impact or vibration absorption performance of the bottom plate 4 can be improved.

The bottom plate 4 includes: through-holes 5 formed by the inner annular support parts 42; through-holes 5 formed by the inner annular support parts 42, the outer annular support parts 42 and beam parts 43, and through-holes 5 formed by the outer annular support parts 42, the circumferential edge parts 402, and beam parts 43. The bottom plate 4 is formed with ribs 51 surrounding the through-holes 5. The ribs 51 are reinforcing parts extending along the peripheral edges of the through-holes 5.

The circumferential edge parts 402 each has a tilted surface 403 whose height is lowered toward the inner side in the radial direction. The tilted surface 403 is part of the upper surface of the glass placement part 40, and extends along the circumferential edge of the opening 401 to surround the opening 401. When a glass is stored with the center of the glass displaced from the center of the glass placement part 40, the glass is guided so that the center of the glass is brought close to the center of the glass placement part 40 by the tilted surface 403 of the circumferential edge part 402.

The divider 3 is a partition wall that separates the two glass storage compartments, formed in a shape extending in the vertical direction, and arranged opposite to the narrow walls. Each of the glass storage compartments is an internal space surrounded by the two wide walls opposite to each other in the lateral direction, and a narrow wall and the divider 3 that are opposite to each other in the longitudinal direction.

<Side Wall Member 20>

Figure 4:
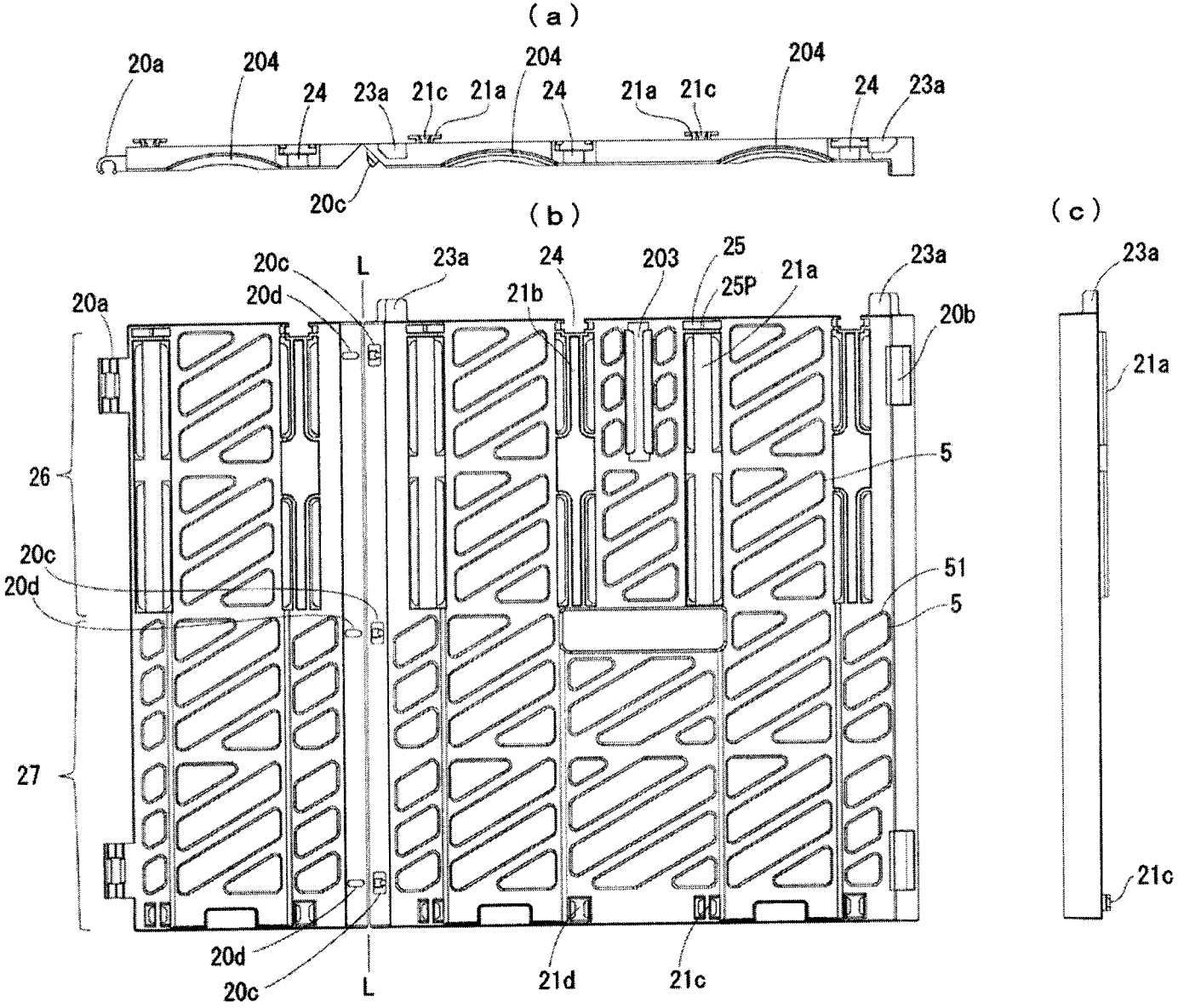
FIG. 4 is a diagram illustrating developing a side wall member 20 constituting the side wall 2 of the glass storage tool 1.

FIG. 4 is a diagram illustrating developing a side wall member 20 constituting the side wall 2 of the glass storage tool 1, in which (a) illustrates the upper end surface of the side wall member 20, (b) illustrates the inner wall surface, and (c) illustrates a side end surface. In the diagram, the outer shape of the side wall member 20 and the outlines of through-holes 5 are drawn by thick lines.

The side wall member 20 is formed in a flat plate shape in which one wide wall and one narrow wall are connected to each other, and used in a state of being folded in an L-shape. The side wall member 20 is folded along a folding line L extending in the vertical direction. The side wall 2 is formed by coupling two folded side wall members 20. Paired tilted surfaces are provided sandwiching the folding line L, and by folding the side wall member 20 at a right angle, the paired tilted surfaces meet each other. The tilted surfaces are provided with protrusion parts 20*c* and engagement holes 20*d*, and the folded state of the side wall member 20 is configured not to be easily released by fitting the protrusion parts 20*c* of one of the tilted surfaces into the engagement holes 20*d* of the other tilted surface.

The side wall member 20 is formed of a network structure member having many through-holes 5, and provided with coupling parts 20*a* and 20*b* for coupling the side wall members 20 to each other, a rail part 203 for engaging the divider 3, bottom plate engagement parts 204 for engaging the bottom plate 4, rail parts 21*a*, engagement grooves 21*b*, protrusion parts 21*c*, engagement holes 21*d*, engagement convex parts 23*a*, engagement concave parts 23*b*, and engagement holes 24 and 25.

The side wall member 20 is formed of an upper area 26 where the rail parts 21*a* and the engagement grooves 21*b* are formed and a lower area 27 on the lower side of the upper area 26, and the lower area 27 is formed with more through-holes 5 than the upper area 26.

The coupling parts 20*a* are convex parts for engaging with the coupling parts 20*b* of the other side wall member 20, and protrude from a side end surface of the side wall member 20. The coupling parts 20*b* are concave parts for accommodating the coupling parts 20*a* of the other side wall member 20 to engage with claws of the coupling parts 20*a*. The coupling parts 20*a* and 20*b* are coupled by relatively moving the two side wall members 20 in the horizontal direction. The coupling parts 20*a* and 20*b* are provided near the upper end and near the lower end of the side wall member 20.

The rail part 203 is an engagement convex part extending in the vertical direction, protrudes from the inner wall surface of the side wall member 20, and includes two claws whose cross sections along the horizontal surface are L-shaped. The rail part 203 is provided in the center of the wide wall in its width direction, and engages with a side end part of the divider 3. Also, the rail part 203 is provided in the upper part of the upper area 26. The bottom plate engagement parts 204 are locking parts for locking the bottom plate 4 to prevent the bottom plate 4 from falling out downward, and are provided at the lower end of the side wall member 20.

Ribs 51 are formed surrounding the through-holes 5 only on the outer wall surface of the side wall member 20, but not present on the inner wall surface. Such ribs 51 make it possible to smooth the inner wall surface while suppressing the strength of the side wall member 20 from being reduced by the many through-holes 5.

The rail parts 21*a* and the engagement grooves 21*b* are provided only in the upper area 26 of the side wall member 20, but not present in the lower area 27. For this reason, the total area of the openings of many through-holes 5 is larger in the lower area 27 than in the upper area 26. When storing a wine glass with the lip facing downward for washing the wine glass, the lower area 27 of the side wall 2 is opposite to the main body part of the wine glass. Therefore, the washing liquid can be uniformly sprayed to the whole of the main body part of the wine glass through the through-holes 5 in the lower area 27.

<Bottom Plate 4>

FIG. 5 is a diagram illustrating the bottom plate 4 of the glass storage tool 1, in which (a) illustrates the lower surface of the bottom plate 4 and (b) illustrates a side end surface. In the diagram, the outer shape of the bottom plate 4 and the outlines of the through-holes 5 are drawn by thick lines. The bottom plate 4 is provided with: multiple protrusions 44 for restricting the bottom plate 4 from moving upward when attaching the bottom plate 4 to the side wall 2; and an engagement hole 45 for engaging with the divider 3.

The protrusions 44 are formed in a shape protruding from the outer wall surface of the frame part 41, and provided on both longitudinal side end surfaces and both lateral side end surfaces of the bottom plate 4. The engagement hole 45 is an insertion opening extending in the lateral direction and opening upward, and formed in the longitudinal center.

The ribs 51 are formed only on the lower surface of the bottom plate 4 so as to surround the through-holes 5, but not present on the upper surface. Such ribs 51 make it possible to smooth the inner surface while suppressing the strength of the bottom plate 4 from being reduced by the many through-holes 5.

<Divider 3>

Figure 6:
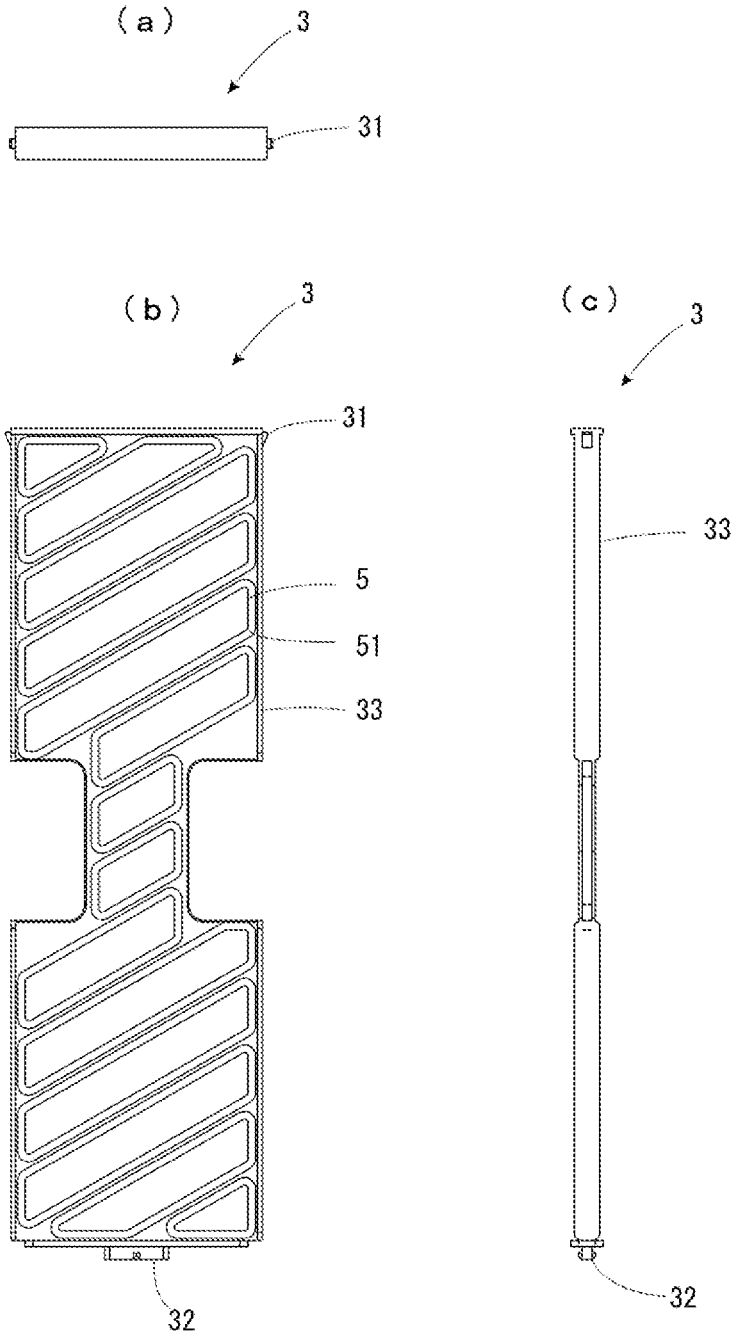
FIG. 6 is a diagram illustrating a divider 3 of the glass storage tool 1.

FIG. 6 is a diagram illustrating the divider 3 of the glass storage tool 1, in which (a) illustrates the upper end surface of the divider 3, (b) illustrates a wall surface, and (c) illustrates a side end surface. In the diagram, the outer shape of the divider 3 and the outlines of through-holes 5 are drawn by thick lines. The divider 3 is a flat plate extending in the vertical direction, and the width of the central part is narrower than the other parts.

The divider 3 is provided with: engagement convex parts 31 for engaging with the side wall 2; an engagement convex part 32 for engaging with the bottom plate 4; and frame parts 33 for engaging with the rail parts 203 of the side wall 2. The engagement convex parts 31 are engaged with the upper end of the side wall 2 to thereby serve as stoppers that restrict the divider 3 from moving upward, and provided at the upper end of the divider 3. The engagement convex parts 31 are respectively provided on both side end surfaces of the divider 3.

The engagement convex part 32 is formed in a shape protruding from the lower end surface of the divider 3, and inserted into the engagement hole 45 of the bottom plate 4 to thereby restrict the divider 3 from moving in the horizontal direction. The frame parts 33 extend in the vertical direction, and are respectively formed at both side end parts of the divider 3.

Ribs 51 are formed on both wall surfaces of the divider 3 so as to surround through-holes 5, but not present on the other wall surface. Such ribs 51 make it possible to suppress the strength of the divider 3 from being reduced by many through-holes 5.

The above-described side wall member 20, bottom plate 4, and divider 3 are high in stiffness, and formed of a resin material superior in moldability into a mesh-like plate-shaped body, for example, polypropylene (PP) having heat resistance.

An assembling method when assembling the glass storage tool 1 from the two side wall members 20, the bottom plate 4, and the divider 3 is as follows. First, the two side wall members 20 are both brought into a flat state, the coupling parts 20*a* of one of the side wall members 20 are inserted into the coupling parts 20*b* of the other side wall member 20, and on the other side as well, the coupling parts 20*a* of the other side wall member 20 are inserted into the coupling parts 20*b* of the one side wall member 20. Then, by engaging the protrusion parts 20*c* and the engaging holes 20*d* on the tilted surfaces together while folding both the side wall members 20 in the L-shape, the side wall members 20 are coupled to each other to complete the side wall 2.

Subsequently, by moving the bottom plate 4 downward through the upper opening of the side wall 2 and locking it to the bottom plate engagement parts 204 of the side wall 2, the bottom plate 4 is fixed to the lower end of the side wall 2. Then, by engaging the frame parts 33 with the rail parts 203 of the side wall 2 while moving the divider 3 downward through the upper opening of the side wall 2 with the divider 3 facing the narrow walls, and inserting the engagement convex part 32 into the engagement hole 45 of the bottom plate 4, the divider 3 is fixed to the side wall 2 and to the bottom plate 4 to complete the glass storage tool 1.

<Stopper 6>

Figure 7:
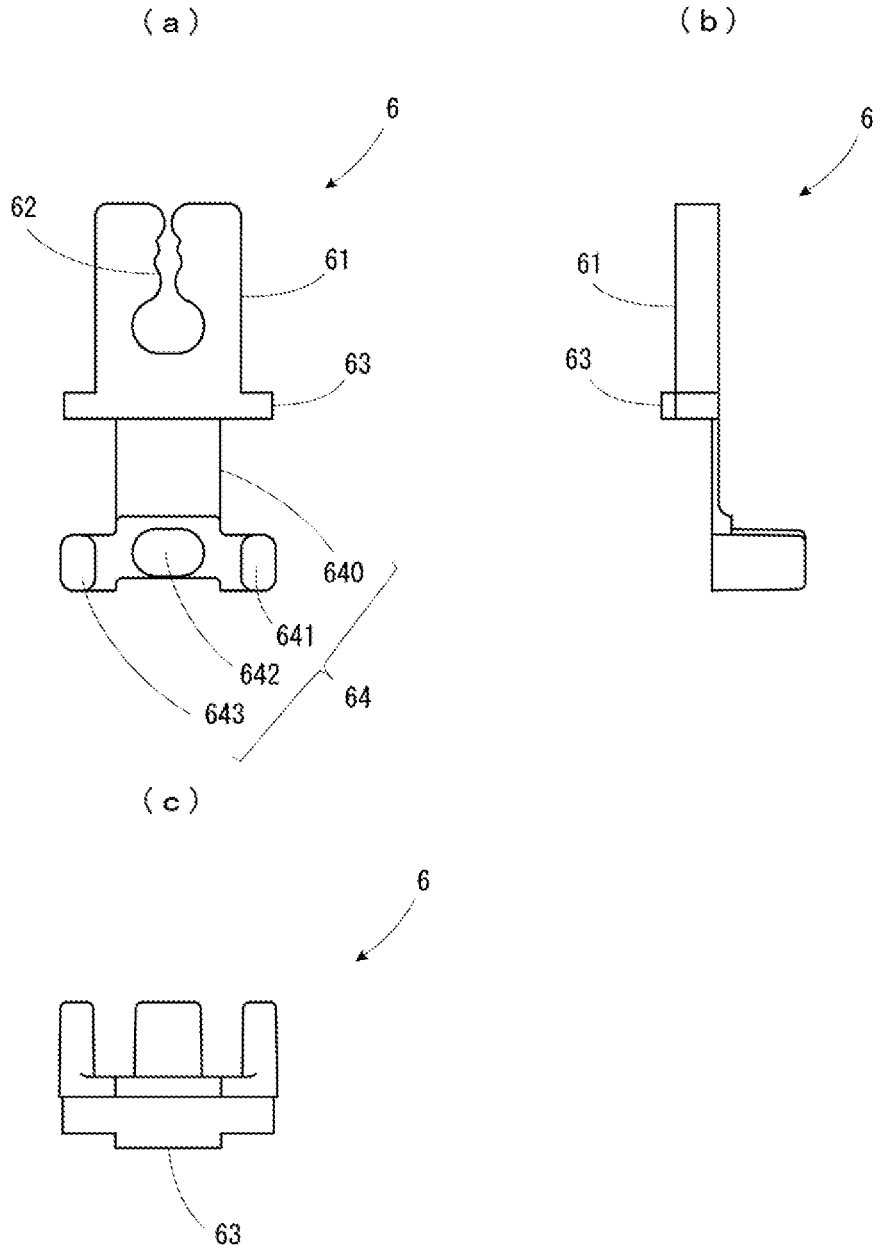
FIG. 7 is diagrams illustrating a stopper 6 used when coupling two glass storage tools 1 to each other.
Figure 8:
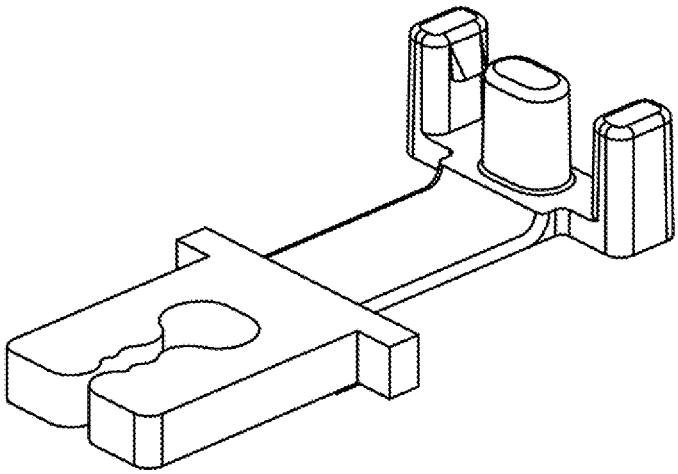
FIG. 8 is a perspective view illustrating the stopper 6.
Figure 8:
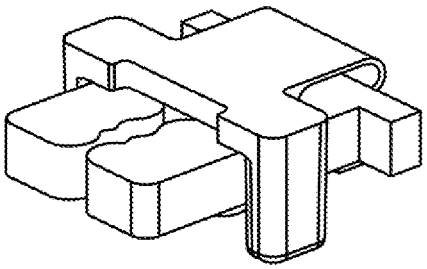

FIG. 7 and FIG. 8 are diagrams illustrating each of the stoppers 6 used when coupling two glass storage tools 1 to each other. FIG. 7(*a*) illustrates the upper surface of the stopper 6, FIG. 7(*b*) illustrates a side end surface, and FIG. 7(*c*) illustrates the back end surface in an insertion direction. In addition, FIG. 8(*a*) illustrates a perspective view of the stopper 6 before use, and FIG. 8(*b*) illustrates a perspective view of the stopper 6 in use.

The stoppers 6 are engagement members that pass through the engagement holes 24 provided at the upper end of one of two side walls 2 coupled by the storage tool coupling parts 21 and are inserted into the engagement holes 25 provided at the upper end of the other to thereby restrict the two glass storage tools 1 from sliding in the vertical direction.

The stoppers 6 each consists of: a flat plate-shaped insertion part 61; a slit part 62 provided in the insertion part 61; a locking part 63 provided at the back end of the insertion part 61; and a falling-out prevention part 64 extending backward from the locking part 63.

The insertion part 61 is inserted into the engagement hole 24, 25 of the side wall 2. The slit part 62 is formed in a shape extending in the insertion direction of the stopper 6, i.e., in an up-down direction of FIG. 7(*a*). Meanwhile, in the engagement hole 25, a sandwiched plate 25P extending in the insertion direction of the stopper 6 is provided. For this reason, when the insertion part 61 is inserted into the engagement hole 25, the slit part 62 sandwiches the sandwiched plate 25P and the stopper 6 is engaged with the side wall 2 on the engagement hole 25 side. At this time, the locking part 63 abuts on the side wall 2 on the engagement hole 24 side. For this reason, the stopper 6 connects the two glass storage tools 1 and restricts vertical sliding.

The fall-out prevention part 64 consists of a flat plate-shaped extension part 640 and three pins 641 to 643 provided at the fore end of it. The extension part 640 is formed in an easily foldable thin shape, and when folding the extension part 640, the three pins 641 to 643 are arranged respectively intersecting with the insertion part 61. At this time, the pins 641 and 643 on both sides are arranged on both sides of the insertion part 61 so as to sandwich the insertion part 61, and the center pin 642 is inserted into the slit part 62. The pins 641 and 643 on both sides are locking pins that sandwich the insertion part 61 to thereby suppress the slit part 62 from opening, and prevent the stopper 6 from falling off. The center pin 642 is a positioning pin for arranging the pins 641 and 643 on both sides so as to sandwich the insertion part 61, and can also be omitted. In addition, the pins 641 and 643 on both sides are provided with engagement protrusions on the surfaces opposite to the insertion part 61, and configured not to easily release a state of sandwiching the insertion part 61.

A coupling method when coupling two or more glass storage tools 1 in the longitudinal direction or the lateral direction is as follows. First, by relatively sliding two glass storage tools 1 in the vertical direction with the side walls 2 facing each other, and accommodating the rail parts 21*a* of one of the side walls 2 in the engagement grooves 21*b* of the other side wall 2, the two glass storage tools 1 are coupled to each other in the upper areas 26 of the side walls 2. In this state, the protrusion parts 21*c* of the one side wall 2 are accommodated in the engagement holes 21*d* of the other side wall 2, and thereby the two glass storage tools 1 are coupled to each other in the vicinities of the lower ends of the side walls 2 as well.

Then, by engaging the stoppers 6 with the engagement hole 25 at the upper end of the other side wall 2 through the engagement holes 24 provided at the upper end of the one side wall 2 of the two side walls 2 coupled by the storage tool coupling parts 21, the two glass storage tools 1 are restricted from sliding in the vertical direction. Further, by folding the extension parts 640 of the fall-out prevention parts 64 and inserting the pins 641 to 643, the stoppers are prevented from falling out, resulting in the completion of the coupling work.

In the glass storage tool 1, the width of the wide walls is approximately twice the width of the narrow walls, and other two glass storage tools 1 can be coupled to one of the wide walls without a gap. That is, two glass storage tools 1 can be coupled to each other in an L-shape. For this reason, when coupling two or more glass storage tools 1 in the longitudinal direction or the lateral direction, the degree of freedom of coupling is high. For example, four glass storage tools 1 can be coupled in a square shape as viewed from above.

Figure 9:
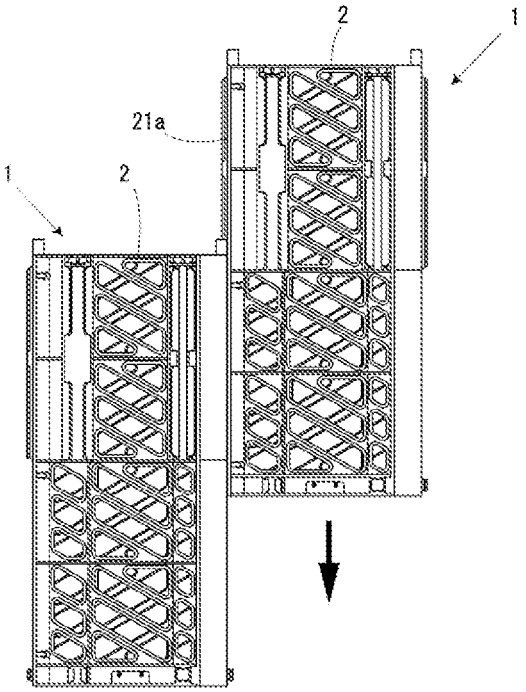
FIG. 9 is a diagram illustrating a situation when coupling two glass storage tools 1 to each other.
Figure 9:
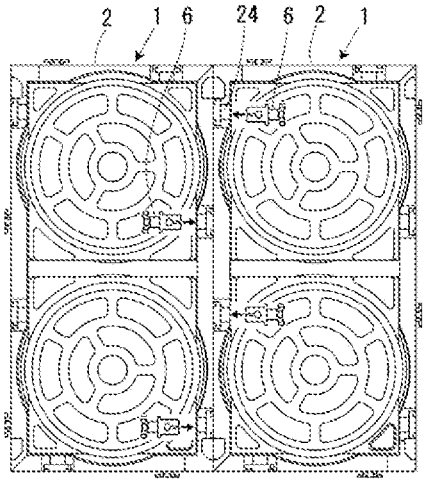
Figure 10:
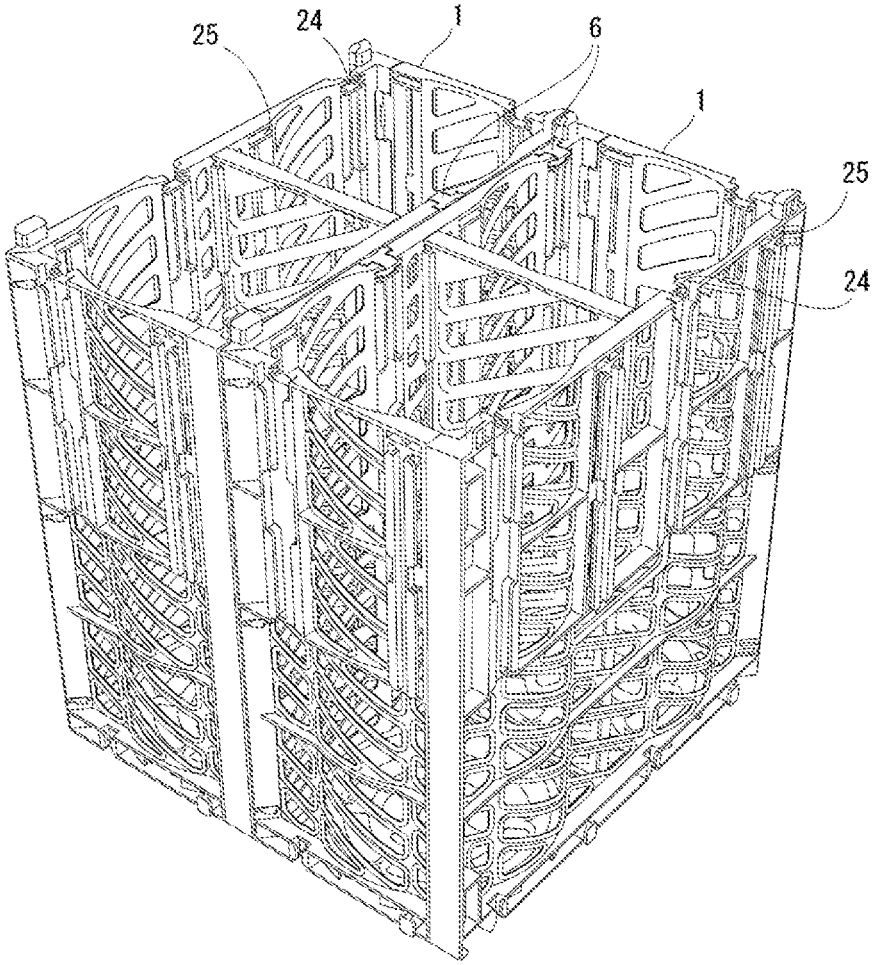
FIG. 10 is a perspective view illustrating a glass storage system in which two glass storage tools 1 are connected.

FIG. 9 is a diagram illustrating a situation when coupling two glass storage tools 1 to each other. FIG. 10 is a perspective view illustrating a glass storage system in which two glass storage tools 1 are connected. FIG. 9(*a*) illustrates a situation where by relatively sliding the two glass storage tools 1 in the vertical direction with the side walls 2 facing each other, the glass storage tools 1 are coupled to each other. When coupling the two glass storage tools 1 in the same attitude in the lateral direction, it is only necessary to, while relatively sliding the two glass storage tools 1 in the vertical direction with wide walls facing each other, accommodate the rail parts 21*a* provided on one of the wide walls in the engagement grooves 21*b* provided on the other wide wall.

FIG. 9(*b*) illustrates a situation where by inserting the stoppers 6, the two side walls 2 are restricted from sliding in the vertical direction. The two side walls 2 coupled by the storage tool coupling parts 21 are restricted by at least two stoppers 6 whose insertion directions are opposite from sliding in the vertical direction. The wide walls are coupled to each other at four sites in the longitudinal direction by the rail parts 21*a* and the engagement grooves 21*b*, and restricted by the four stoppers 6 from moving in the vertical direction. The stoppers 6 are horizontally inserted from inside the engagement holes 24, and by folding the fall-out prevention parts 64, the stoppers 6 can be suppressed from falling out.

Since the two glass storage tools 1 coupled by the rail parts 21*a* and the engagement grooves 21*b* are restricted by the stoppers 6 from mutually sliding in the vertical direction, the two glass storage tools 1 are tightly coupled to each other. For this reason, when two or more glass storage tools 1 are mutually coupled, the glass storage tools 1 can be prevented from being easily mutually separated.

Also, by differentiating the insertion directions of the multiple stoppers 6 engaging with the two side walls 2 coupled by the rail parts 21*a* and the engagement grooves 21*b*, they can be suppressed from simultaneously falling out by impact or vibration at the time of a fall.

Figure 11:
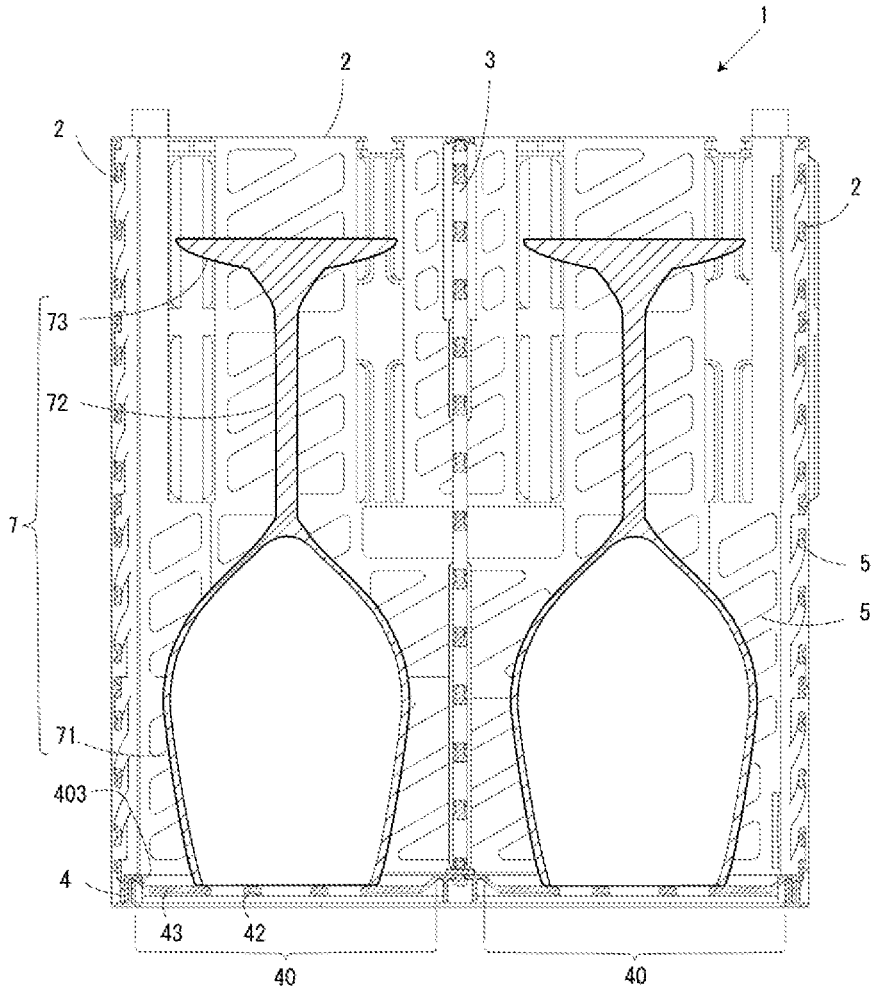
FIG. 11 is a diagram illustrating glasses 7 stored in the glass storage tool 1.

FIG. 11 is a diagram illustrating glasses 7 stored in the glass storage tool 1, in which the glass storage tool 1 is cut by a plane parallel to the wide wall surfaces 2W to show the glasses 7. The glasses 7 are wine glasses and each consists of a main body part 71, a leg part 72, and a base part 73. In the glass storage tool 1, the glasses 7 are stored in a state where the lips (rim parts) of the main body parts 71 face downward, i.e., in an upside-down state. The lips of the main body parts 71 are annular in shape.

The glasses 7 are placed on the glass placement parts 40 of the bottom plate 4. The glass placement parts 40 are held at a position higher than the lower end of the side wall 2, and therefore a space for when locally deformed can be secured. Accordingly, when an external force is applied to the bottom plate 4 by causes such as the fall of the glass storage tool 1, the external force can be absorbed by the local deformation of the glass placement parts 40. Also, the beam parts 43 are likely to cause the relative displacement in the radial direction, whereas the annular support parts 42 are unlikely to cause the relative displacement in the circumferential direction. For this reason, impact or vibration is absorbed by the relative displacement of the beam parts 43 in the radial direction, while the relative displacement in the circumferential direction is suppressed, making is possible to suppress a force from being concentrated on parts of the lips of the main body parts 71.

By providing the circumferential edge parts of the glass placement parts 40 with the tilted surfaces 403, when the glasses 7 are stored with the centers of the glasses 7 displaced from the centers of the glass placement parts 40, the glasses 7 are guided so that the centers of the glasses 7 are brought close to the centers of the glass placement parts 40 by the tilted surfaces 403. For this reason, the glasses 7 can be suppressed from being held in a state where the lips of the main body parts 71 are largely displaced from the annular support parts 42. In addition, since the distances between the side wall 2 and the glasses 7 are secured regardless of a state at the time of storage, the performance of protecting the glasses 7 from impact or vibration at the time of a fall can be improved.

The total area of the openings of many through-holes 5 is larger in the lower area 27 than in the upper area 26 of the side wall 2, and the lower area 27 is opposite to the main body parts 71 of the glasses 7. For this reason, when washing the glasses 7, the washing liquid can be uniformly sprayed to the whole of the main body parts 71 through the through-holes 5 in the lower area 27 to improve the washability of the glasses 7.

In addition, in the glass storage tool 1, the glasses 7 may be stored with the lips (rim parts) of the main body parts 7 facing upward. Storing with the lips (rim parts) facing upward makes it possible to prevent leftovers from spilling at the time of carrying, or the like.

The glass storage tool 1 according to the present embodiment is capable of holding the glasses 7 without easily breaking them. In particular, since a space for when the bottom plate 4 is locally deformed is secured, the performance of absorbing impact or vibration at the time of a fall can be ensured. In addition, since a force can be suppressed from being concentrated on the rim parts of the glasses 7, the rim parts of the glasses 7 can be prevented from being damaged.

Further, since two glass storage tools 1 are tightly coupled to each other by the rail parts 21*a*, the engagement grooves 21*b*, and the stoppers 6, when two or more glass storage tools 1 are mutually coupled, the glass storage tools 1 can be prevented from being easily mutually separated.

In addition, in the present embodiment, described is an example of a case where wine glasses are stored in the glass storage tool 1; however, the present invention can also be applied to, for example, storage tools that store champagne glasses and cocktail glasses other than a wine glass.

Also, in the present embodiment, described is an example of a case where the two glasses 7 are stored in the one glass storage tool 1; however, the present invention is not one that limits the configuration of the glass storage tool 1 to this. For example, in one glass storage tool 1, one glass 7 may be stored, or three or more glasses 7 may be stored.

Further, in the present embodiment, described is an example of a case where the two annular support parts 42 are arranged within the opening 401 of the glass placement part 40; however, the present invention is not one that limits the configuration of the glass placement part 40 to this. For example, three or more annular support parts 42 may be configured to be arranged within the opening 401.

DESCRIPTION OF REFERENCE NUMERALS

1 glass storage tool
2 side wall
20 side wall member
20*a*,20*b* coupling part
20*c* protrusion part
20*d* engagement hole
203 rail part
204 bottom plate engagement part
21 storage tool coupling part
21*a* rail part
21*b* engagement groove
21*c* protrusion part
21*d* engagement hole
23*b* engagement convex part
23*a* engagement concave part
24,25 engagement hole
26 upper area
27 lower area
3 divider
4 bottom plate
40 glass placement part
401 opening
402 circumferential edge part
403 tilted surface
41 frame part
42 annular support part
43 beam part
5 through-hole
51 rib
6 stopper
61 insertion part
62 slit part
63 locking part
64 fall-out prevention part
7 glass

The invention claimed is:

1. A glass storage tool comprising:

a side wall that is configured to surround a glass; and a bottom plate that has a glass placement part configured such that a glass is placed in an upside-down state on the glass placement part and the glass placement part comprises a bottom that is held at a position higher than a lower end of the side wall such that a space is defined by the lower end and the bottom, wherein the glass placement part has a substantially circular opening and two or more annular support parts substantially concentrically arranged within the opening, an outermost one of the annular support parts is connected to a circumferential edge part of the opening by three or more beam parts extending in a radial direction, and the annular support parts are mutually connected by three or more beam parts extending in the radial direction, the annular support parts and the beam parts each have a thickness and a width, the thickness being a dimension in a vertical direction relative to the side wall and the width being a dimension in a horizontal direction relative to the side wall, the annular support parts and the beam parts are all such that the thickness is a half or less of the width, and the beam parts bend or curve in the vertical direction into the space according to an external force applied to the bottom plate to absorb an impact thereof.

2. The glass storage tool according to claim 1, wherein the beam parts are formed differentiated in circumferential position between an inner side and an outer side of each of the annular support parts.

3. The glass storage tool according to claim 1, wherein the bottom plate is formed with ribs that surround through-holes formed between the annular support parts and the beam parts within the opening.

4. The glass storage tool according to claim 1, wherein an upper surface of the circumferential edge part is a tilted surface whose height is lowered toward an inner side in the radial direction.

5. The glass storage tool according to claim 1, where said side wall is configured to fully enclose the glass.

* * * * *